US007078990B1

(12) United States Patent
Patel et al.

(10) Patent No.: US 7,078,990 B1
(45) Date of Patent: Jul. 18, 2006

(54) RF CAVITY RESONATOR WITH LOW PASSIVE INTER-MODULATION TUNING ELEMENT

(75) Inventors: Kanti N. Patel, Newtown, PA (US); R. Mark Clark, Langhorne, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 125 days.

(21) Appl. No.: 10/845,167

(22) Filed: May 14, 2004

(51) Int. Cl.
*H01P 7/10* (2006.01)
*H01P 7/04* (2006.01)
*H01P 1/20* (2006.01)

(52) U.S. Cl. ..... 333/219.1; 333/224; 333/202; 333/235

(58) Field of Classification Search ..... 333/219.1, 333/219, 202, 235, 222–224
See application file for complete search history.

(56) References Cited

U.S. PATENT DOCUMENTS 2,103,515 A * 12/1937 Conklin et al. ..... 333/234
4,613,838 A * 9/1986 Wada et al. ..... 333/232
4,728,913 A * 3/1988 Ishikawa et al. ..... 333/235
4,730,174 A * 3/1988 Nishikawa et al. ..... 333/224
4,810,984 A * 3/1989 Arnold et al. ..... 333/202
5,686,874 A * 11/1997 Piirainen ..... 333/234
5,691,677 A * 11/1997 De Maron et al. ..... 333/219.1
5,754,084 A * 5/1998 Hietala ..... 333/229
5,764,114 A * 6/1998 Kuhne ..... 333/12
6,255,922 B1 * 7/2001 Malmstrom et al. ..... 333/219.1
6,362,708 B1 * 3/2002 Woods ..... 333/234
6,549,092 B1 * 4/2003 Hattori et al. ..... 333/134
6,600,394 B1 * 7/2003 Wang et al. ..... 333/235

* cited by examiner

*Primary Examiner*—Robert Pascal
*Assistant Examiner*—Kimbelry E. Glenn
(74) *Attorney, Agent, or Firm*—McDermott Will & Emery LLP

(57) ABSTRACT

A tunable RF cavity resonator having reduced generation of passive inter-modulation, the tunable RF cavity resonator including a cavity body, a fixed tuning post at a first end of the cavity body, a dielectric rod in the fixed tuning post interior space with a first spatial gap between the dielectric rod outer surface and the fixed tuning post inner wall, a tuning screw connected to a first end of the dielectric rod, and a tuning element disposed on a second end of the dielectric rod so that the tuning element moves within the interior space of the fixed tuning post while maintaining a second spatial gap between the tuning element outer surface and the fixed tuning post inner wall. Accordingly, the tuning element forms a short section of very low RF impedance transmission line thereby preventing RF signal leakage through the interior space of the fixed tuning post.

19 Claims, 4 Drawing Sheets

RF CAVITY RESONATOR WITH LOW PASSIVE INTER-MODULATION TUNING ELEMENT

STATEMENT AS TO RIGHTS TO INVENTIONS MADE UNDER FEDERALLY SPONSORED RESEARCH OR DEVELOPMENT

NOT APPLICABLE TO THIS INVENTION.

BACKGROUND OF THE INVENTION

1. Field of the Invention

The present invention concerns a re-entrant radio frequency (RF) cavity resonator filter which achieves a low level of generated passive inter-modulation (PIM) by having a tuning element which does not have contact with the fixed tuning post of the re-entrant cavity resonator.

2. Description of the Related Art

Conventional RF cavity resonators are typically tunable so that the resonator may be used across a given range of operating frequencies. Such a conventional RF resonator typically consists of a cavity body, either cylindrical or rectangular, in which a fixed tuning (resonator) post resides inside of the cavity body by being connected at one end to a wall of the cavity body. The fixed tuning post of the typical resonator is generally a tubular, cylindrical shape with a far end opposite the connection to the cavity body being open. The typical fixed tuning post is usually machined as an integral part of the cavity body, and the inside tube of the typical fixed tuning post accommodates a rotatable post that is also cylindrical in nature and that has a metallic tuning element attached at one end near the open end of the fixed tuning post. The metallic tuning element typically moves relative to the fixed tuning post by having screw-type threads on the outer surface of the metallic tuning element which correspond to screw-type threads provided on the inner surface of the inside tube of the fixed tuning post.

The end of the rotatable post which is opposite the metallic tuning element is usually attached to an adjusting knob which protrudes out of the cavity body near the cavity body wall to which the fixed tuning post is connected. Accordingly, the user of a typical RF cavity resonator can adjust the operating frequency of the resonator by turning the adjusting knob which turns the threaded metallic tuning post at the end of the rotatable post within the threads on the inside of the fixed tuning post, thereby linearly moving the metallic tuning element within the fixed tuning post in a controlled manner. As the metallic tuning element is moved relative to the open end of the fixed tuning post, the operating frequency of the cavity resonator is "tuned" to a new frequency.

Unfortunately, although the above-described typical RF cavity resonator achieves the goal of tuning the cavity resonator to a different frequency, there are certain deleterious effects caused by the use of the "screw-type" metallic tuning post mentioned above. Specifically, the metal-to-metal contact between the threaded outer surface of the metallic tuning element and the threaded inner surface of the fixed tuning post causes the generation of passive inter-modulation (PIM) during operation of the cavity resonator. The generated PIM can result in unwanted distortion of the outgoing signal from the cavity resonator.

In addition, repeated tuning of the typical RF cavity resonator can cause the threads on the outer surface of the metallic tuning element and the threads on the inner surface of the fixed tuning post to wear and deteriorate. When the threads become worn and deteriorated, they become mismatched and thereby result in unstable positioning of the metallic tuning element within the cavity body of the cavity resonator. This results in an inability to accurately move the metallic tuning to a specific location, thereby preventing accurate tuning of the cavity resonator in a repeatable and uniform fashion.

Accordingly, it is desirable to have a RF cavity resonator which reduces the amount of PIM generated by contact between the metallic tuning element and the inside of the fixed tuning post. In addition, it is desirable to have a cavity resonator which can be repeatedly tuned in an accurate, repeatable and uniform fashion.

SUMMARY OF THE INVENTION

The present invention solves the above problems by providing a re-entrant RF cavity resonator filter with a metallic tuning element that has no contact with the fixed tuning post of the re-entrant cavity resonator, thereby reducing levels of generated passive inter-modulation, and providing the ability to be tuned in an accurate, repeatable and uniform fashion.

Specifically, according to one aspect of the invention, a tunable RF cavity resonator is provided which has reduced generation of passive inter-modulation. The tunable RF cavity resonator includes a cavity body, a fixed tuning post which is fixed to a first end of the cavity body, the fixed tuning post having an outer wall forming an exterior surface of the fixed tuning post, and having an inner wall forming an interior space within the fixed tuning post, a dielectric rod disposed in the interior space of the fixed tuning post such that a first spatial gap is maintained between an outer surface of the dielectric rod and the inner wall of the fixed tuning post, a tuning screw connected to a first end of the dielectric rod near the first end of the cavity body, and a tuning element disposed on a second end of the dielectric rod opposite the first end of the dielectric rod, and being disposed to move within the interior space of the fixed tuning post such that a second spatial gap is maintained between an outer surface of the tuning element and the inner wall of the fixed tuning post.

Preferably, the fixed tuning post has a cylindrical tube shape with one open end inside of the body cavity, and the dielectric rod has a cylindrical shape. In this regard, the fixed tuning post has a length equal to either 60 degrees or 90 degrees of the center frequency of the cavity resonator. The tuning screw is preferably threaded and connected to a threaded section provided at the first end of the dielectric rod. The second spatial gap between the outer surface of the tuning element and the inner wall of the fixed tuning post is preferably less than 0.005 inches to ensure that the high power multipactor breakdown of the signal is below a cut-off threshold, while still maintaining contact-free tuning movements to prevent passive inter-modulation. The cavity resonator is preferably electrically connected so that the first end of the fixed tuning post is short-circuited (maximum current), and the second end of the fixed tuning post is open-circuited (maximum voltage).

In this manner, the present invention provides a tunable RF cavity resonator that includes a metallic tuning element which has no metal-to-metal contact with the fixed tuning post of the cavity resonator, thereby minimizing levels of generated passive inter-modulation, and that has the ability to be repeatedly tuned in an accurate and uniform fashion.

This brief summary has been provided so that the nature of the invention may be understood quickly. A more complete understanding of the invention can be obtained by reference to the following detailed description thereof in connection with the attached drawings.

DETAILED DESCRIPTION

The present invention is generally directed to a re-entrant cavity resonator filter which achieves a low level of generated passive inter-modulation (PIM) by having a tuning element which has no metal-to-metal contact with the fixed tuning post of the re-entrant cavity resonator. Also, the cavity resonator of the present invention provides the ability to be tuned in an accurate, repeatable and uniform fashion.

Figure 1A:
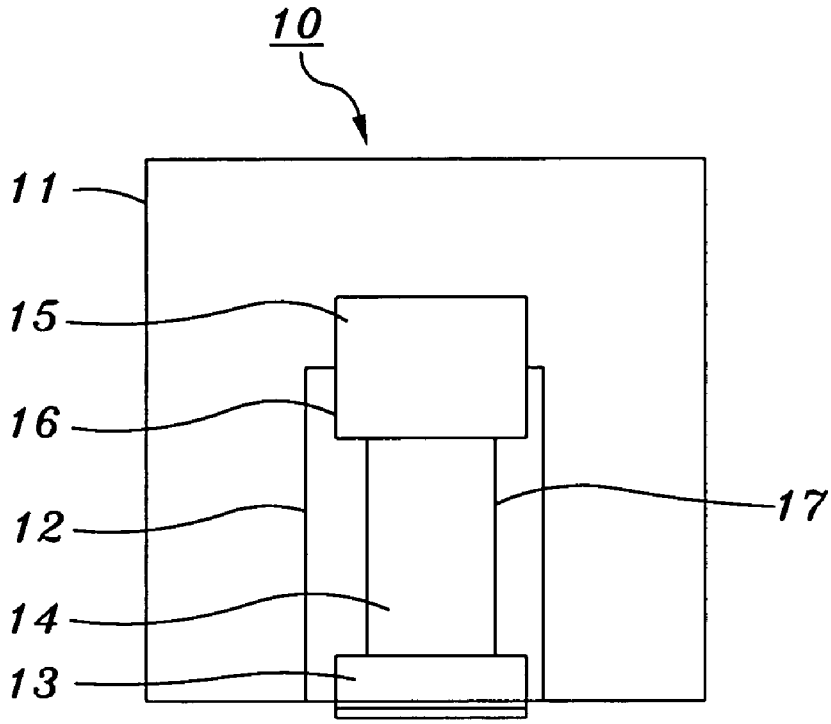
FIG. 1A is a basic schematic drawing showing a side view of a tunable RF cavity resonator according to one embodiment of the invention.

Turning to the drawings, FIG. 1A shows a side view of a tunable RF cavity resonator according to the present invention. As seen in FIG. 1A, tunable RF cavity resonator 10 is shown which is comprised of several components. Specifically, tunable RF cavity resonator 10 includes cavity body 11, fixed tuning post 12, dielectric rod 14, tuning element 15 and tuning screw 13. Cavity body 11 is preferably either a rectangular shape, such as a square, or a cylindrical shape, and has a cavity area disposed inside. Fixed tuning post 12 is disposed inside the cavity area of cavity body 11 and is affixed to the first end of cavity body 11 so that fixed tuning post 12 is rigidly held in place with respect to cavity body 11. Fixed tuning post 12 is made of a conductive metal and has a cylindrical, tube shape with an open end opposite of the end that is affixed to cavity body 11.

Fixed tuning post 12 acts as a resonator within cavity body 11 and preferably has a length between sixty (60) to ninety (90) degrees of a frequency which is at the center of the operating frequency bandwidth of cavity resonator 10. In other words, fixed tuning post 12 preferably has a length between ⅙ to ¼ the wavelength of the center operating frequency of cavity resonator 10. Preferably, fixed tuning post 12 is electrically connected through cavity resonator 10 to be open-circuited (maximum voltage) at the open end, and short-circuited (maximum current) at the affixed end.

Dielectric rod 14 is a cylindrical shape and is disposed inside of fixed tuning post 12 such that spatial gap 17 is maintained between the outer surface of dielectric rod 14 and the inner wall of fixed tuning post 12. In this regard, dielectric rod 14 is made of a dielectric material and functions to support tuning element 15. In addition, dielectric rod 14 makes the inside of fixed tuning post 12 behave like a circular waveguide below the cutoff, thereby preventing propagation of radio frequency signals inside fixed tuning post 12. As seen in FIG. 1A, dielectric rod 14 is positioned within the inner tube of fixed tuning post 12, is attached at one end to cavity body 11 by means of tuning screw 13, and has tuning element 15 attached to its other end near the open end of fixed tuning post 12. Rotation of tuning screw 13 moves dielectric rod 14 in a linear direction parallel to the longitudinal axis of fixed tuning post 12, thereby moving tuning element 15 in a linear direction toward or away from the open end of fixed tuning post 12.

The outer surface of tuning element 15 in the present invention maintains spatial gap 16 with respect to the inner wall of fixed tuning post 12, thereby avoiding any metal-to-metal contact which is commonly associated with conventional cavity resonators that have a threaded tuning element in contact with a threaded inner wall of the fixed tuning post. According to the foregoing arrangement, a user can tune cavity resonator 10 to a particular center operating frequency by rotating tuning screw 13 in the appropriate direction thereby moving tuning element 15 to the appropriate position with respect to fixed tuning post 12. Also, tuning element 15 forms a short section of very low RF impedance transmission line thereby preventing RF signal leakage through the interior space of fixed tuning post 12.

Figure 1B:
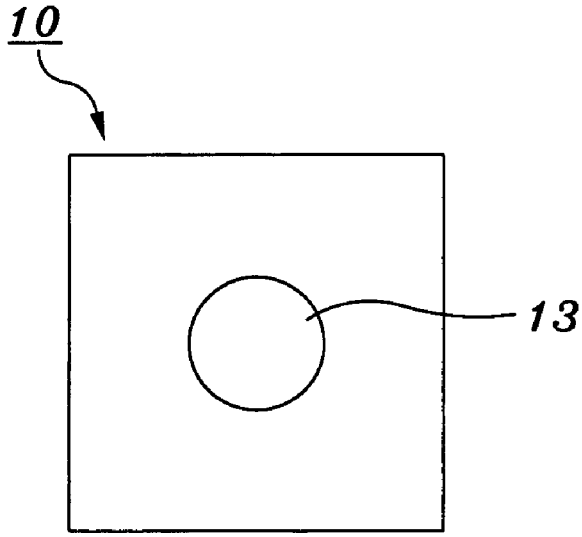
FIG. 1B is a basic schematic drawing showing a top view of the tunable RF cavity resonator shown in FIG. 1.

FIG. 1B is a top view of cavity resonator 10 shown in FIG. 1A. Although tuning screw 13 is shown at the bottom end of cavity resonator 10 in FIG. 1A, cavity resonator 10 is typically positioned in operation in an inverted position with respect to FIG. 1A so that tuning screw 13 is shown at the top of FIG. 1B. In this manner, the user of cavity resonator 10 can conveniently access tuning screw 13 to adjust the center operating frequency of cavity resonator 10.

Figure 2:
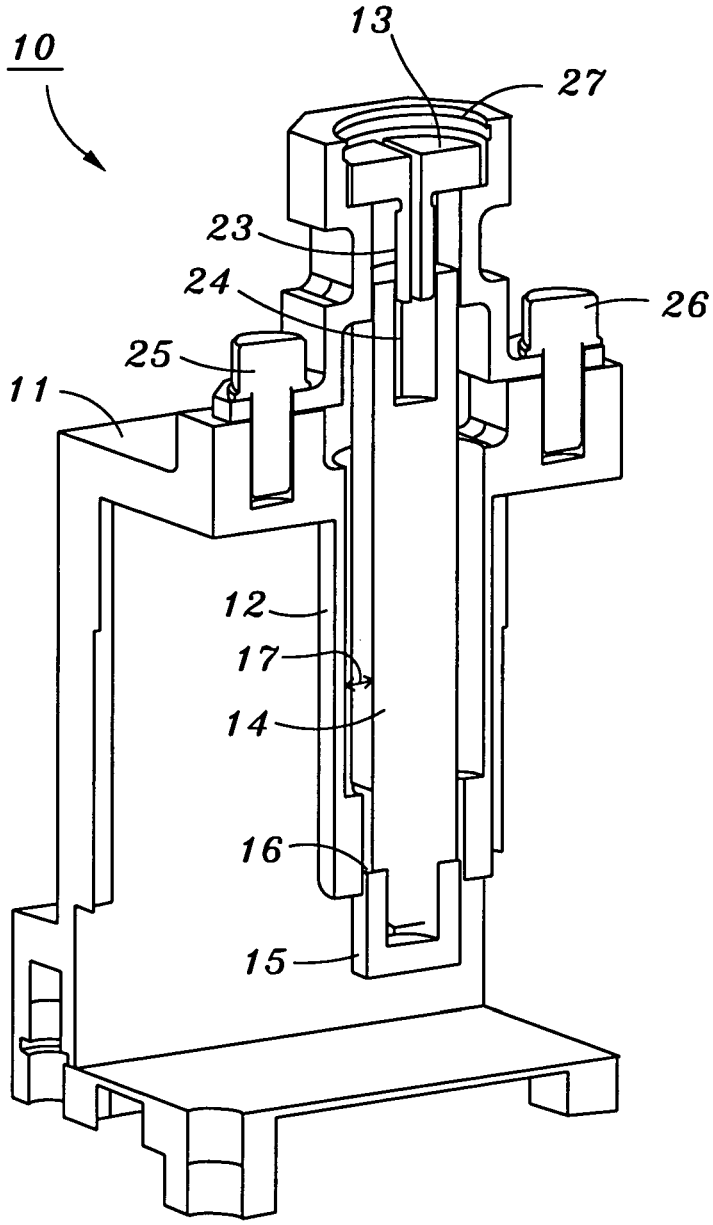
FIG. 2 is a schematic drawing showing a cut-away perspective of a tunable RF cavity resonator according to one embodiment of the invention.

FIG. 2 is a more detailed diagram of RF cavity resonator 10. As seen in FIG. 2, cavity body 11 is shown in more detail than in FIG. 1A. An explanation of the various elements of cavity resonator 10 shown in FIG. 2 has been previously provided above with respect to FIG. 1A and will therefore not be repeated here for the sake of brevity. For example, cavity body 11, fixed tuning post 12, dielectric rod 14, tuning element 15 and tuning screw 13 are generally arranged and function as described above with respect to FIG. 1A. Accordingly, only those additional elements and more detailed features shown in FIG. 2 will be further explained. In this regard, loop contacts 25 and 26 can be seen on the end of cavity body 11 so that RF cavity resonator 10 can be electrically connected to a signal source for use as a filter, etc. Preferably, RF cavity resonator 10 is electrically connected so that the first end of fixed tuning post 12 is electrically short-circuited with maximum current, and the second end of the fixed tuning post 12 is electrically open-circuited with maximum voltage.

FIG. 2 shows that dielectric rod 14 is positioned within fixed tuning post 12, and that dielectric rod 14 supports tuning element 15 at one end near the opening of fixed tuning post 12. In addition, dielectric rod 14 is seen to maintain spatial gap 17 with respect to the inner wall of fixed tuning post 12, and tuning element 15 is seen to maintain spatial gap 16 with respect to the inner wall of fixed tuning post 12. Preferably, spatial gap 16 is less than 0.005 in order to prevent multipaction breakdown while also avoiding metal-to-metal contact between fixed tuning post 12 and tuning element 15. Also, in the embodiment shown in FIG. 2, spatial gap 17 between dielectric rod 14 and fixed tuning post 12 is greater than spatial gap 16 between tuning element 15 and fixed tuning post 12.

The tuning mechanism which allows the user to move dielectric rod 14, and therefore tuning element 15, is now explained in more detail with respect to FIG. 2. In particular, it can be seen in FIG. 2 that dielectric rod 14 has threaded notch section 24 at then end in which dielectric rod 14 passes through cavity body 11. Tuning screw 13 is disposed within retainer section 27 which is attached to the end of cavity body 11 at which dielectric rod 14 protrudes. Tuning screw 13 also has threaded section 23 which corresponds to threaded notch section 24 of dielectric rod 14. Accordingly, dielectric rod 14 and tuning screw 13 are threaded together. Although tuning screw 13 is rotatable, tuning screw 13 is maintained in the same linear position with respect to cavity body 11 because tuning screw 13 is held in place by the grooves shown in retainer section 27.

In this manner, when tuning screw 13 is rotated, threaded section 23 of tuning screw 13 engage threaded notch section 24 of dielectric rod 14, and since tuning screw 13 is restrained from linear movement by retainer section 27, dielectric rod 14 is moved in a linear direction as tuning screw 13 is rotated. As dielectric rod 14 is moved in a linear direction, so is tuning element 15 moved at the end of dielectric rod 14, thereby tuning cavity resonator 10 to a particular center operating frequency. Preferably, the threads of threaded section 23 and threaded notch section 24 are formed so that dielectric rod 14 and tuning element 15 are movably translated in a linear direction away from the first end of cavity body 11 when tuning screw 13 is rotated in a counterclockwise direction, and so that dielectric rod 14 and tuning element 15 are movably translated in a linear direction toward the first end of cavity body 11 when tuning screw 13 is rotated in a clockwise direction. Of course, other arrangements of threads will work with the present invention.

According to the foregoing arrangement, RF cavity resonator 10 can be repeatedly tuned to a center operating frequency by rotating tuning screw 13 without having any metal-to-metal contact between tuning element 15 and fixed tuning post 12, thereby avoiding generation of passive inter-modulation. In addition, the absence of threaded metal-to-metal contact between tuning element 15 and fixed tuning post 12 allows for repeated uniform tuning, unlike conventional threaded-type tuning elements in which the threads eventually wear down, thereby resulting in imprecise positioning of the tuning element.

Figure 3:
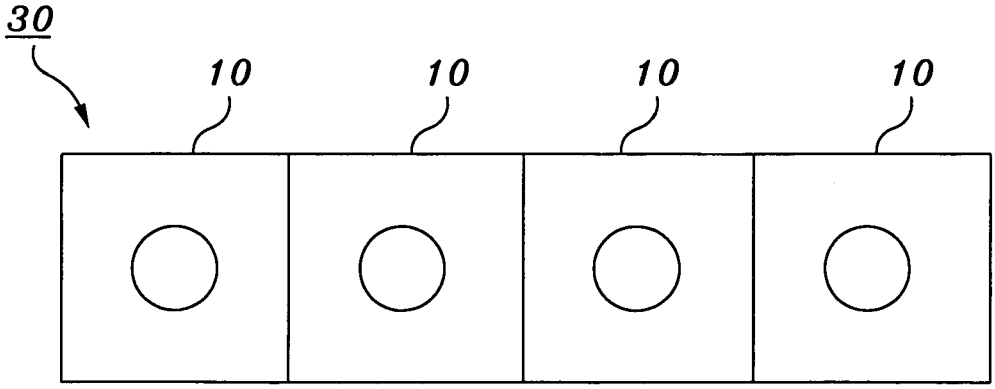
FIG. 3 is a basic schematic drawing showing a multiple cavity resonators according to one embodiment of the invention arranged to operate as a diplexer.

FIG. 3 depicts another embodiment of the invention in which multiple RF cavity resonators 10 are arranged together in a pattern to form a diplexer for transmission or reception of multiple simultaneous, independent signals on two different frequencies. Preferably, the diplexer of FIG. 3 has a generated passive inter-modulation level of less than −140 dBm. Of course, other arrangements of RF cavity resonators 10 can be used for a diplexer, and for other functions such as filters, etc.

Figure 4A:
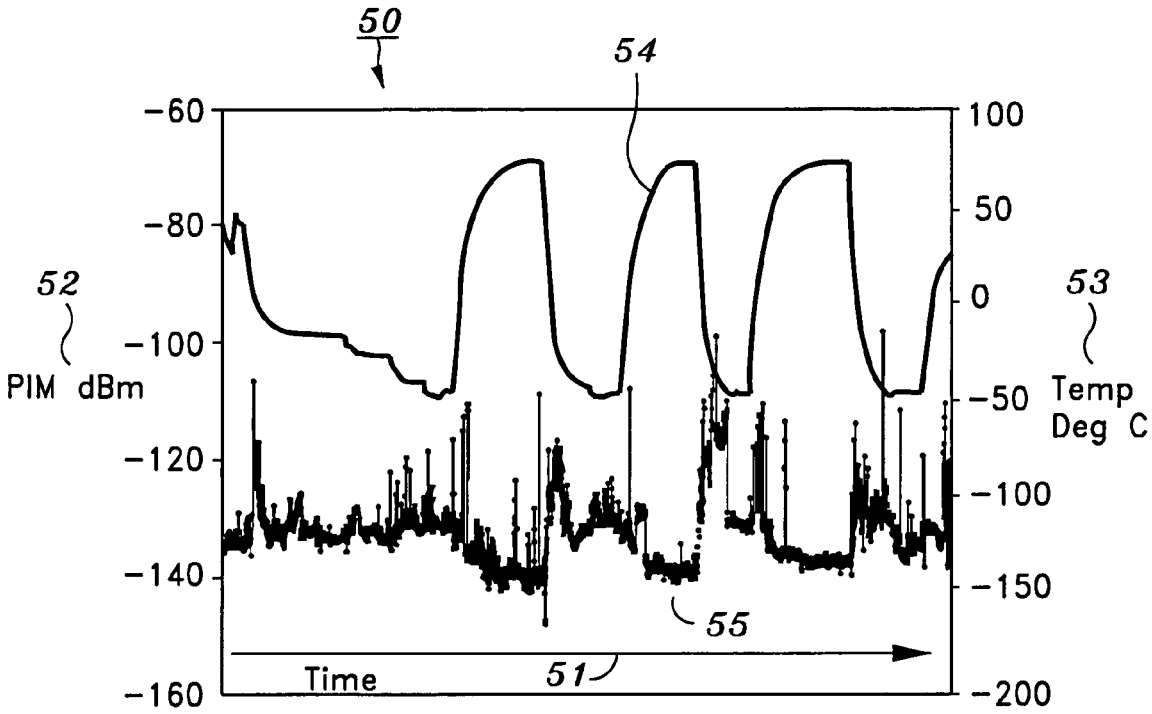
FIG. 4A is a graph depicting measured passive intermodulation (PIM) over multiple temperature cycles for a conventional screw-type cavity resonator.
Figure 4B:
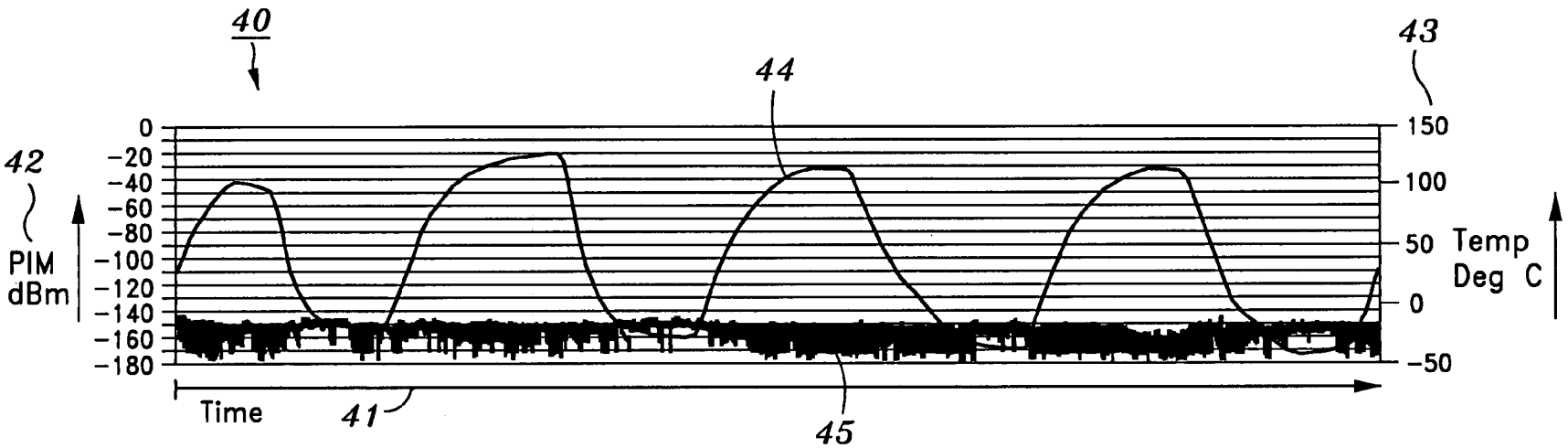
FIG. 4B is a graph depicting measured passive intermodulation (PIM) over multiple temperature cycles for a tunable RF cavity resonator according to one embodiment of the invention.

FIGS. 4A and 4B demonstrate the improvement of the present contact-less tuning element RF cavity resonator over the conventional thread-type RF cavity resonator. Specifically, turning to FIG. 4A, graph 50 is provided which shows the amount of generated passive inter-modulation (PIM) of a conventional RF cavity resonator having a thread-type tuning element over a series of four temperature cycles. Left axis 52 indicates the measured amount of PIM in dBm, and right axis 53 indicates the temperature in degrees Centigrade. Bottom axis 51 indicates the passage of time. As seen by graphed PIM 55, the PIM level of the conventional thread-type RF cavity resonator is significantly high with PIM levels up to −98 dbm, with respect to graphed temperature cycles 54. As seen below with respect to FIG. 4B, the PIM level associated with the RF cavity resonator of the present invention is much lower than the conventional RF cavity resonator depicted in FIG. 4A.

Turning to FIG. 4B, graph 40 is provided which shows the amount of generated passive inter-modulation (PIM) of RF cavity resonator 10 of the present invention having a contact-free tuning element over a series of four temperature cycles. Left axis 42 indicates the measured amount of PIM in dBm, and right axis 43 indicates the temperature in degrees Centigrade. Bottom axis 41 indicates the passage of time. As seen by graphed PIM 45, the PIM level of RF cavity resonator 10 of the present invention is maintained at a low level of less than −140 dbm during the four graphed temperature cycles 44.

Accordingly, the arrangement of the present invention results in a tunable RF cavity resonator that includes a metallic tuning element which has no metal-to-metal contact with the fixed tuning post of the cavity resonator, thereby minimizing levels of generated passive inter-modulation, and thereby providing the ability to be repeatedly tuned in an accurate and uniform fashion.

The invention has been described with respect to particular illustrative embodiments. It is to be understood that the invention is not limited to the above-described embodiments and that various changes and modifications may be made by those of ordinary skill in the art without departing from the spirit and scope of the invention.

What is claimed is:

1. A tunable radio frequency (RF) cavity resonator having reduced generation of passive inter-modulation, the tunable RF cavity resonator comprising:

a cavity body;

a fixed tuning post which is fixed to a first end of the cavity body, the fixed tuning post having an outer wall forming an exterior surface of the fixed tuning post, and having an inner wall forming an interior space within the fixed tuning post;

a dielectric rod disposed in the interior space of the fixed tuning post such that a first spatial gap is maintained between an outer surface of the dielectric rod and the inner wall of the fixed tuning post;

a tuning screw connected to a first end of the dielectric rod near the first end of the cavity body; and a tuning element disposed on a second end of the dielectric rod opposite the first end of the dielectric rod, and being disposed to move within the interior space of the fixed tuning post such that a second spatial gap is maintained between an outer surface of the tuning element and the inner wall of the fixed tuning post.

2. The tunable RF cavity resonator of claim 1, wherein the dielectric rod disposed in the interior space of the fixed tuning post acts as a circular wave guide operating below a cut-off level at an operating frequency of the tunable RF cavity resonator, thereby substantially preventing propagation of an RF signal past the tuning element.

3. The tunable RF cavity resonator of claim 1, wherein the cavity body has a cylindrical shape.

4. The tunable RF cavity resonator of claim 1, wherein the cavity body has a rectangular shape.

5. The tunable RF cavity resonator of claim 1, wherein the fixed tuning post and the tuning element each have a cylindrical shape.

6. The tunable RF cavity resonator of claim 1, wherein the fixed tuning post is open at an end.

7. The tunable RF cavity resonator of claim 1, wherein the first end of the dielectric rod has a threaded section disposed therein, and wherein the tuning screw has a corresponding threaded section which connects to the threaded section of the dielectric rod.

8. The tunable RF cavity resonator of claim 7, wherein the dielectric rod and the tuning element are movably translated in a linear direction within the cavity body when the tuning screw is rotated.

9. The tunable RF cavity resonator of claim 8, wherein the dielectric rod and the tuning element are movably translated in a linear direction away from the first end of the cavity body when the tuning screw is rotated in a counterclockwise direction.

10. The tunable RF cavity resonator of claim 8, wherein the dielectric rod and tuning element are movably translated in a linear direction toward the first end of the cavity body when the tuning screw is rotated in a clockwise direction.

11. The tunable RF cavity resonator of claim 1, wherein the dielectric rod is made of a dielectric material, and wherein the tuning element is made of a metallic material.

12. The tunable RF cavity resonator of claim 1, wherein the first spatial gap is greater in size than the second spatial gap.

13. The tunable RF cavity resonator of claim 1, wherein the second spatial gap between the outer surface of the tuning element and the inner wall of the fixed tuning post is less than 0.005 inches.

14. The tunable RF cavity resonator of claim 1, wherein the fixed tuning post has a length between ⅙ and ¼ of a predetermined wavelength.

15. The tunable RF cavity resonator of claim 14, wherein the predetermined wavelength corresponds to a center frequency of the tunable cavity resonator.

16. The tunable RF cavity resonator of claim 1, wherein a first end of the fixed tuning post is electrically short-circuited with maximum current, and a second end of the fixed tuning post is electrically open-circuited with maximum voltage.

17. The tunable RF cavity resonator of claim 1, wherein a plurality of the tunable cavity resonators are joined together to form a diplexer.

18. The tunable RF cavity resonator of claim 17, wherein the diplexer has a generated passive inter-modulation level of less than −140 dBm.

19. The tunable RF cavity resonator of claim 1, wherein the tunable RF cavity resonator is configured for uses as a filter.

* * * * *